US012338582B2

(12) United States Patent
Bustamante et al.

(10) Patent No.: US 12,338,582 B2
(45) Date of Patent: Jun. 24, 2025

(54) TRANSFER CAR FOR SLEEPERS AND THE ASSOCIATED RAILWAY VEHICLE

(71) Applicant: MATISA MATERIEL INDUSTRIEL S.A., Crissier (CH)

(72) Inventors: Jorge Bustamante, Crissier (CH); Jacques Pilet, Crissier (CH)

(73) Assignee: MATISA MATERIEL INDUSTRIEL S.A., Crissier (CH)

( * ) Notice: Subject to any disclaimer, the term of this patent is extended or adjusted under 35 U.S.C. 154(b) by 498 days.

(21) Appl. No.: 17/227,028

(22) Filed: Apr. 9, 2021

(65) Prior Publication Data

US 2021/0317616 A1 Oct. 14, 2021

(30) Foreign Application Priority Data

Apr. 11, 2020 (FR) ..... 2003670

(51) Int. Cl.
*E01B 29/06* (2006.01)
*E01B 29/05* (2006.01)
(Continued)

(52) U.S. Cl.
CPC ..... *E01B 29/06* (2013.01); *E01B 29/05* (2013.01); *E01B 29/09* (2013.01); *E01B 29/10* (2013.01);
(Continued)

(58) Field of Classification Search
CPC ..... E01B 29/06; E01B 29/09; E01B 29/10; E01B 29/11; E01B 29/13
(Continued)

(56) References Cited

U.S. PATENT DOCUMENTS 3,713,396 A * 1/1973 Colius ..... E01B 29/06 104/9
4,152,990 A * 5/1979 Theurer ..... E01B 29/06 414/626
(Continued)

FOREIGN PATENT DOCUMENTS

EP 1825061 A1 8/2007
EP 2555564 A1 2/2013
(Continued)

OTHER PUBLICATIONS

FR2003670, Nov. 16, 2020, French Search Report.
Third Party Observation for European Application No. 21167758.8, submitted Nov. 29, 2024, mailed Dec. 5, 2024, 4 pages.

*Primary Examiner* — S. Joseph Morano
*Assistant Examiner* — James William Jones
(74) *Attorney, Agent, or Firm* — RAY QUINNEY & NEBEKER P.C.; Paul N. Taylor

(57) ABSTRACT

The invention relates to a transfer car (100) for sleepers designed to outfit a railway vehicle of the type comprising equipment for laying down new sleepers (21) and/or removing worn sleepers (22), the transfer car (100) comprising an undercarriage (110) supported by at least one running gear (112), the transfer car (100) being characterized in that it comprises at least one traverser (50) supported by an armature (60), the armature (60) being supported by the undercarriage (110) and fixed in relation to the undercarriage (110), the traverser (50) being configured to move the sleepers from at least one receiving zone (Z1, Z2) to at least one conveying platform (P2).

14 Claims, 4 Drawing Sheets

(51) Int. Cl.

| | |
|---|---|
| ***E01B 29/09*** | (2006.01) |
| ***E01B 29/10*** | (2006.01) |
| ***E01B 29/11*** | (2006.01) |
| ***E01B 29/13*** | (2006.01) |
| *E01B 27/02* | (2006.01) |

(52) U.S. Cl.
CPC ..... *E01B 29/11* (2013.01); *E01B 29/13* (2013.01); *E01B 27/02* (2013.01); *E01B 2203/032* (2013.01)

(58) Field of Classification Search
USPC ..... 104/6
See application file for complete search history.

(56) References Cited

U.S. PATENT DOCUMENTS 4,184,431 A * 1/1980 Goel ..... E01B 29/05 105/215.1
4,253,398 A * 3/1981 Theurer ..... E01B 29/05 104/2
2001/0050023 A1* 12/2001 Theurer ..... E01B 29/06 104/2
2002/0005139 A1* 1/2002 Theurer ..... E01B 27/08 104/2
2002/0121216 A1* 9/2002 Theurer ..... E01B 29/11 104/9
2004/0045472 A1* 3/2004 Therurer ..... E01B 29/06 104/2

FOREIGN PATENT DOCUMENTS

| | | | |
|---|---|---|---|
| FR | 2299459 | * | 1/1975 |
| FR | 2736367 A1 | | 1/1997 |
| FR | 2760473 A1 | | 9/1998 |
| GB | 2029874 A | | 3/1980 |
| WO | WO2006021878 | | 3/2006 |
| WO | WO2019129678 | | 7/2019 |

* cited by examiner

TRANSFER CAR FOR SLEEPERS AND THE ASSOCIATED RAILWAY VEHICLE

TECHNICAL FIELD OF THE INVENTION

The invention relates in general to the technical field of construction and replacement trains, which are used to provide the necessary equipment for the construction of railroad tracks or to replace some or all of the materials making up the tracks, namely, the rails and the sleepers, as well as the ballast which holds the track together, when these materials have become degraded.

The invention relates more specifically to a transfer car for sleepers designed to outfit a railway vehicle such as an associated railway vehicle.

PRIOR ART

The builders or operators of railway transport networks often need to construct new railroad tracks or refurbish existing railroad tracks, that is, replace certain of the elements of which they are composed, such as the rails and the sleepers supporting the rails, as well as the means of fastening and other accessories. A great deal of the need for replacement is due to the age and the wear of the tracks, but it may also be a question of replacing old models with more recent models to allow better performance.

In the most complete case of replacement or construction, such operations are performed by using a railway convoy, such as a replacement or construction train comprising multiple specialized machines to perform the different operations of replacement or construction. A typical replacement operation uses specialized railway convoys comprising machines able to perform the following operations in sequence: ballast clearing, ballast screening and evacuation of the ballast clearing products, by conveyor belts on cars designed for unloading or by direct jet on the embankment, the replacement of the refurbished track (rails and sleepers), ballasting and raising of the track, leveling and straightening, the welding of the rails, the releasing of the fixtures, another leveling and straightening, the adjustment of the berms, and the cleaning of the shoulders.

Whether it involves construction or replacement, such a railway convoy comprises multiple transport cars for sleepers, at least new sleepers and optionally old sleepers, in order to supply the specialized machines such as the equipment for laying down new sleepers and optionally the removal of worn sleepers.

It is known how to arrange, on such an assemblage of cars, a continuous working path for a gantry which, in the course of its back and forth movements, picks up new sleepers at a first storage car, moves them to a second car, especially onto a conveyor belt going to the equipment for laying them down, and optionally picks up on its return trip the worn sleepers which have been collected on a third car, which may correspond to the second car, and places them on a fourth storage car, which may correspond to the first car.

The use of such a gantry is not without shortcomings. In particular, the back and forth travel of the gantry on its working path at relatively elevated speed along multiple cars requires precautions and particular attention in order to prevent accidents for the people located on board or alongside the train during the operations of laying down and removing new and worn sleepers.

Furthermore, the document WO2019129678A1 illustrates a transfer car for pallets between an upper conveyor located on an upper level of the car and a lower conveyor located on a lower level of the car, the two conveyors being placed one above the other and having opposite directions of circulation. The transfer is carried out by an elevator having a purely vertical movement between an upper receiving zone located at the exit from the upper conveyor and a conveying platform located at the entrance to the lower conveyor, directly beneath the upper conveyor.

EXPLANATION OF THE INVENTION

The invention intends to remedy some or all of the shortcomings of the prior art by proposing in particular a solution to assure the transfer of sleepers while eliminating the shortcomings involved in the movement of this gantry along its working path.

In order to do so, there is proposed, according to a first aspect of the invention, a transfer car for sleepers designed to outfit a railway vehicle such as a consist or train, the transfer car comprising an undercarriage supported by at least one running gear, and further comprising a group of one or more receiving zones comprising at least one receiving zone for sleepers and a group of one or more conveying platforms comprising at least one sleeper conveying platform, the transfer car being characterized in that it comprises at least one traverser supported by an armature, the armature being supported by the undercarriage and fixed in relation to the undercarriage, the traverser being configured to move sleepers from the receiving zone to the conveying platform which is distant from the receiving zone along a longitudinal direction of the transfer car, the traverser being located, in relation to the longitudinal direction of the transfer car, between the receiving zone and the conveying platform.

By traversing, it is meant here the transport takes place by the lifting up and displacing of a load, comprised here of one or more sleepers, from one point to another, here, from the receiving zone to the conveying platform.

A transfer car for sleepers having such a combination of characteristics makes it possible to co-locate the sleeper transfer operations. Thus, this transfer operation is concentrated at a single car and implemented by at least one traverser whose armature is fixed in relation to the undercarriage of that car, which allows an assurance of safety for people who may find themselves in the vicinity of the car, thereby eliminating the constraints associated with the movement of a conventional gantry. Furthermore, the positioning of the sleeper in relation to the receiving zone and the conveying platform allows it to move the sleepers along the longitudinal direction of the car in the same direction as that of its conveyance along the railway vehicle. Each sleeper is thus conveyed and moved in continuous manner in the same direction of conveyance and transfer. The Direction of conveyance and transfer may depend on many aspects, in particular, whether involving new or worn sleepers, and according to the positioning of the sleeper storage zones in relation to the other cars.

The receiving zone and the platform are preferably situated at different heights.

According to one embodiment, the transfer car for sleepers is designed to outfit a railway vehicle of the type comprising equipment for laying down new sleepers, the transfer car further comprising:

- a first zone for receiving and unstacking of new sleepers, belonging to the group of one or more receiving zones, configured to receive the new sleepers coming from the storage zone of the railway vehicle;
- a second platform for conveying new sleepers, belonging to the group of one or more conveying platforms, from which said new sleepers can be conveyed to the equipment for laying down the new sleepers, the second platform for conveying the new sleepers being distant from the first zone of receiving and unstacking of the new sleepers along the longitudinal direction of the transfer car;

the traverser being configured to move the new sleepers from the first receiving zone to the second conveying platform. This allows a co-locating of the operations of transfer of the new sleepers from the first zone for receiving and unstacking of the new sleepers up to the second platform for conveying of the new sleepers.

According to one embodiment, the transfer car is designed to outfit a railway vehicle of the type comprising equipment for removing of worn sleepers, said transfer car comprising:

a first platform for conveying worn sleepers, belonging to the group of one or more conveying platforms, from which the worn sleepers can be conveyed to a storage zone of the railway vehicle;

a second zone for receiving worn sleepers, belonging to the group of one or more receiving zones, configured to receive the worn sleepers from the equipment for removing the worn sleepers, the second zone for receiving worn sleepers being distant from the first platform for conveying of the worn sleepers along the longitudinal direction of the transfer car;

the traverser being configured to move the worn sleepers from the second receiving zone to the first conveying platform. This allows a co-locating of the operations of transfer from the second zone for receiving worn sleepers up to the first platform for conveying of the worn sleepers, preferably in combination with the transfer of the new sleepers from the first zone for receiving and unstacking of the new sleepers up to the second platform for conveying of the new sleepers.

According to one embodiment, the armature supporting the traverser is contained in a volume bounded laterally by a gage of the sleeper transfer car, preferably by a gage of its undercarriage. The dimensions of the armature in width and in length are thus constrained by those of the car, or the undercarriage, which allows observing the safety criteria with a certain compact form free from the constraints of the footprint for travel along a railroad track and which may involve the external surroundings of the railroad track. The length here corresponds to a dimension taken along the longitudinal direction of the car, namely, in the direction of movement along the railroad track, and the width corresponds to a dimension taken along the lateral or transverse direction of the car, perpendicular to the longitudinal direction.

Preferably, the traverser is entirely contained within a volume bounded by a predetermined railway gage, such as a gage recognized by the International Railway Union (UIC), for example the international gage (PPI) or other gages such as the gage GA, GB or GC.

According to one embodiment, there is a single traverser. Such a characteristic offers a simple design while still allowing the implementing of the two transfer streams, one for the new sleepers and, preferably also, one for the worn sleepers.

According to one embodiment, the traverser comprises a system for gripping at least one sleeper suspended from a lifting system which is movable relative to the armature, the system for gripping preferably comprising a spreader configured to transport a plurality of sleepers grouped in a pack. Since this is a gripping system suspended from a lifting system which is movable in relation to the armature, the movable portion of the traverser is at a height relative to the undercarriage in order to further guarantee the safety.

According to one embodiment, the lifting system is carried by a shuttle which is movable in translation relative to the armature, preferably along a translation parallel to a reference axis corresponding to a longitudinal direction of the car.

So as not to obstruct the travel of the traverser, while still assuring the safety during its use, the armature has rails for guiding and supporting the movable shuttle, situated above the at least one receiving zone and the at least one conveying platform, preferably above the first receiving zone and the second conveying platform, and preferably likewise above the second receiving zone and the first conveying platform.

According to one embodiment, the first conveying platform is situated at a height greater than that of the first receiving zone. Alternatively or additionally, the second conveying platform is situated at a height greater than that of the second receiving zone.

According to one embodiment, the first conveying platform and the first receiving zone are closer to a first end of the transfer car than the second conveying platform and the second receiving zone. In one particular configuration, said first end of the car corresponds to the front end of said car. In such a configuration, the first conveying platform and the first receiving zone are situated at the front of the car, the second conveying platform and the second receiving zone being then preferably situated at the rear of the car, in relation to the direction of travel of the railway vehicle. Such an arrangement allows an optimization of the working space of the traverser, especially when the transfer car is placed between the storage cars, on the one hand, and at least one working car, on the other hand, which carries the equipment for laying down new sleepers and/or the equipment for removing worn sleepers.

According to one embodiment, the transfer car comprises an elevating mechanism in at least one of the receiving zones, preferably in the first zone for receiving and unstacking of the new sleepers, being configured to position at least one sleeper, and preferably a pack of sleepers, at a predetermined height. Such an elevating mechanism allows placing the packs of sleepers in a position facilitating the handling by the traverser, so as to limit the sequence time and achieve faster working. The operation of the elevating mechanism may likewise be done in masked time in relation to the movement of the traverser.

According to one embodiment, the transfer car comprises at least one portion of a displacement mechanism for stacks of sleepers to move said stacks of sleepers in translation toward at least one of the receiving zones, preferably toward the first zone for receiving and unstacking of the new sleepers, the displacement mechanism preferably comprising carts configured to be placed on a guide track located beneath the stacks of sleepers.

According to one embodiment, the displacement mechanism is configured to move each cart back and forth, preferably by one step corresponding to a distance greater than the length of a stack of sleepers, the displacement mechanism being configured such that each cart carries a stack of sleepers along a forward path, and configured to travel a return path, opposite the forward path, after being unloaded, and without moving the sleepers. Such a configuration eliminates a system for storing of the carts at the end of the travel, and also a long and bulky return path for the carts.

According to one embodiment, the transfer car comprises a third conveying device, for example for the conveying of material such as ballast, situated vertically beneath the traverser. Of course, this may involve used ballast, new ballast, or even recycled ballast obtained from used ballast after having undergone a recycling treatment.

According to another aspect of the invention, it deals with a vehicle for railroad work of the type comprising for example equipment for laying down new sleepers and/or for removing worn sleepers, the railway vehicle comprising at least one sleeper storage car comprising a storage zone for sleepers, one or more cars containing equipment for laying down new sleepers and/or for removing worn sleepers from a railroad track, characterized in that it furthermore contains a transfer car such as that described above According to one embodiment, the railway vehicle comprises a car for stacking of worn sleepers, having a traverser for stacking of said worn sleepers in order to transfer the worn sleepers coming from the transfer car, the stacking traverser being supported by an associated armature, fixed in relation to the stacking car for worn sleepers. In this way, the stacking traverser likewise assures the safety of any people who might be in its vicinity.

According to one embodiment, the railway vehicle comprises:

- a first evacuation conveying device to convey worn sleepers from the equipment for removing worn sleepers up to the second receiving zone for worn sleepers; and
- a second evacuation conveying device to convey worn sleepers from the first platform for conveying of worn sleepers up to a storage zone of the railway vehicle;

and/or

- a first routing conveying device to convey new sleepers from a storage zone of the railway vehicle up to the first zone for receiving and unstacking of the new sleepers; and
- a second routing conveying device to convey new sleepers from the second platform for conveying of new sleepers up to the equipment for laying down the new sleepers;

the railway vehicle comprising a third conveying device, for example for the conveying of material such as ballast, situated vertically above the first and second evacuation conveying devices and/or the first and second routing conveying devices.

According to another aspect, the invention also relates to a method for transfer of sleepers intended to outfit a railway vehicle of the type comprising for example equipment for laying down new sleepers and/or for removing worn sleepers, the transfer car comprising an undercarriage supported by at least one running gear, and further comprising a group of one or more sleeper receiving zones having at least one sleeper receiving zone and a group of one or more conveying platforms having at least one sleeper conveying platform, the transfer method being characterized in that it involves at least one step of transfer of at least one sleeper from the receiving zone to the conveying platform situated at a distance from the receiving zone along a longitudinal direction of the transfer car, by at least one traverser supported by an armature, the armature being supported by the undercarriage and fixed in relation to the undercarriage, the traverser being situated, in relation to the longitudinal direction of the transfer car, between the receiving zone and the conveying platform.

According to one embodiment, the transfer car comprises:

- a first zone for receiving and unstacking of new sleepers, belonging to the group of one or more receiving zones, configured to receive the new sleepers coming from the storage zone of the railway vehicle;
- a second platform for conveying new sleepers, belonging to the group of one or more conveying platforms, from which said new sleepers can be conveyed to the equipment for laying down the new sleepers, the second platform for conveying the new sleepers being distant from the first zone of receiving and unstacking of the new sleepers along the longitudinal direction of the transfer car and, optionally, at a height different from that of the first zone for receiving and unstacking of the new sleepers;

the transfer step involving a step of transfer of at least one new sleeper from the first receiving zone to the second conveying platform, by the traverser.

According to one embodiment, the transfer car for sleepers comprises:

- a first platform for conveying worn sleepers, belonging to the group of one or more conveying platforms, from which said worn sleepers can be conveyed to a storage zone of the railway vehicle; and
- a second zone for receiving worn sleepers, belonging to the group of one or more receiving zones, configured to receive the worn sleepers from the equipment for removing the worn sleepers, the second zone for receiving worn sleepers being distant from the first platform for conveying of the worn sleepers along the longitudinal direction of the transfer car, and, optionally, at a height different from that of the first platform for conveying the worn sleepers;

the transfer step involving a step of transfer of at least one worn sleeper from the second receiving zone to the first conveying platform by the traverser.

BRIEF DESCRIPTION OF THE FIGURES

Other characteristics and advantages of the invention will emerge from a reading of the following description, making reference to the enclosed figures, which illustrate.

For more clarity, identical or similar elements are given the identical reference marks in all of the figures.

DETAILED DESCRIPTION OF ONE EMBODIMENT

Figure 1:
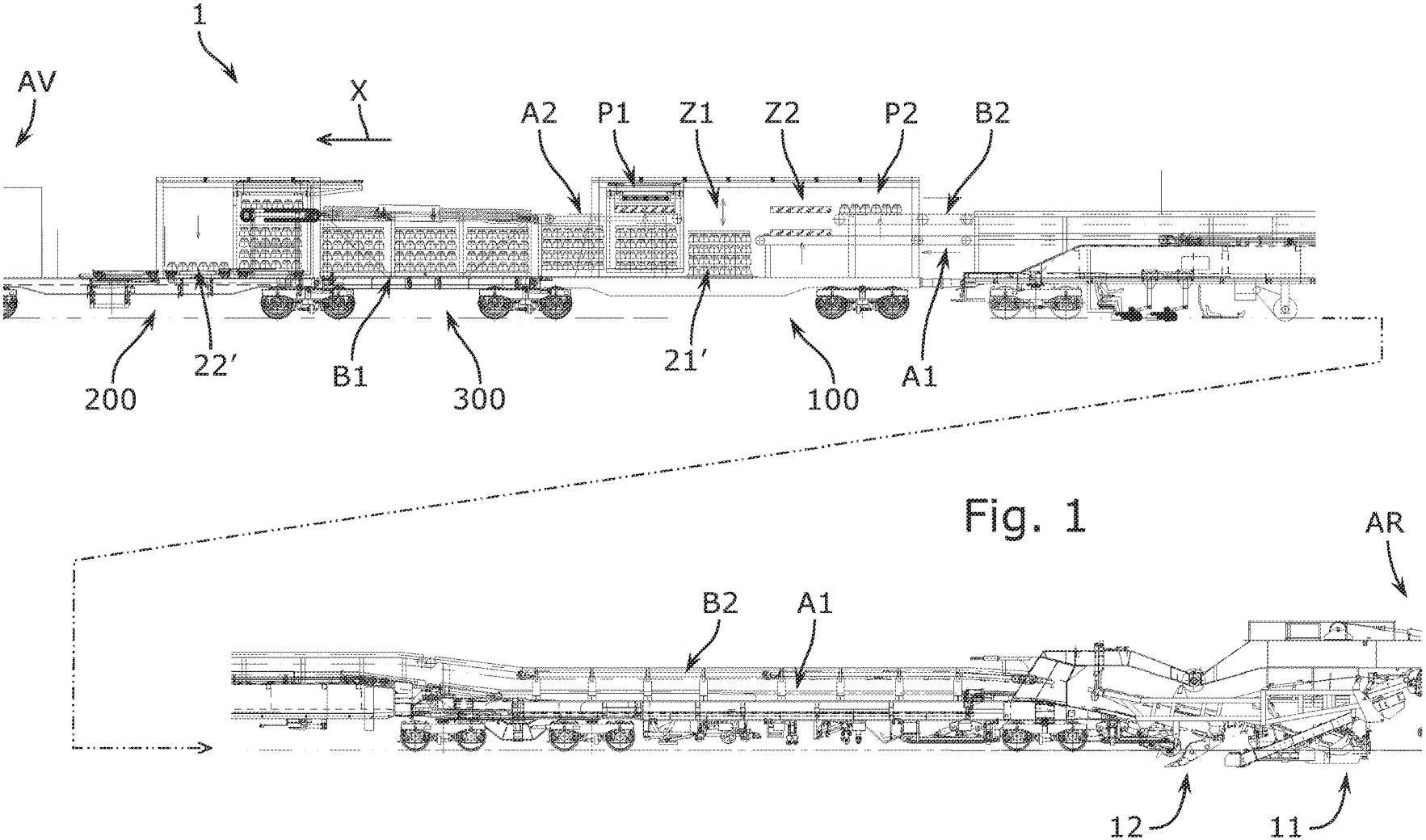
FIG. 1: a profile view of a railway vehicle according to a first embodiment of the invention.

Referring to FIG. 1, this illustrates a railway vehicle 1 of the type comprising equipment for laying down 11 new sleepers 21 and for removing 12 worn sleepers 22. This equipment for laying down and removing sleepers 21, 22 has the chief function of refurbishing railroad tracks, for example in order to perform a replacement of worn sleepers 22 or to replace them with more recent models and thus improve the performance of the railroad tracks.

The railway vehicle 1, for example a replacement train as illustrated in FIG. 1, is formed by a succession of cars which are connected together, being articulated in general to form a railway convoy, and towed by a locomotive. The replacement train 1 during its operation moves in a forward direction and each car extends along a longitudinal direction X, having a front end AV oriented in the forward direction of the train and a rear end AR longitudinally opposite the front end AV.

Referring to FIGS. 1 to 7, the replacement train 1 is equipped with a transfer car 100 for sleepers 21, 22. The transfer car 100 is designed to be moved in relation to the replacement train 1, between on the one hand at least one car comprising equipment for laying down 11 new sleepers 21 and removing 12 worn sleepers 22 and on the other hand storage cars 300 (FIG. 4) for new sleepers 21 and worn sleepers 22. The function of the transfer car 100 is to ensure a continuous flow between:

- an evacuation stream C1 of worn sleepers 22 from the equipment for removing worn sleepers 22 up to a storage zone of the railway vehicle 1, possibly extending over several storage cars, the evacuation stream C1 being oriented in the longitudinal direction of the transfer car and in a first direction; and
- a supply stream C2 of new sleepers 21 from a storage zone of the train up to the equipment for laying down new sleepers 21, the supply stream C2 being oriented in the longitudinal direction of the transfer car and in a second direction, opposite the first direction.

In the configuration illustrated in the figures, the equipment for laying down 11 new sleepers 21 and removing 12 worn sleepers 22 is situated at the rear of the railway vehicle 1 in relation to the transfer car 100 for sleepers 21, 22 and the storage cars 300 are situated at the front of the railway vehicle 1 in relation to the transfer car 100 for sleepers 21, 22. However, the reverse arrangement may be considered.

The transfer car 100, like the other cars of the railway vehicle 1, comprises an undercarriage 110 supported by two bogies 111, situated at the two front and rear ends of the undercarriage 110, and each one provided with one or more running gears 112. For this purpose, it is preferable to ensure that the bogies each comprise a bogie undercarriage, at least two running gears 112, and at least one suspension between the two running gears and the bogie undercarriage. The transfer car 100 is located between the streams C1 and C2, that is, at the intersection of the two streams for evacuation C1 of the worn sleepers 22 on the one hand and supply C2 of new sleepers 21 on the other hand. The transfer car 100 comprises:

- a first zone Z1 for receiving and unstacking of new sleepers 21 configured to receive the new sleepers 21 coming from a storage zone 300 of the railway vehicle 1;
- a first platform P1 for conveying worn sleepers 22, from which said worn sleepers 22 can be conveyed to a storage zone 300 of the railway vehicle 1;
- a second zone Z2 for receiving worn sleepers 22 configured to receive the worn sleepers 22 from the equipment for removing the worn sleepers 22;
- a second platform P2 for conveying new sleepers 21 from which said new sleepers 21 can be conveyed to the equipment for laying down the new sleepers 21.

The transfer car 100 comprises at least one traverser 50 supported by an armature 60, the armature 60 being supported by the undercarriage 110 and fixed in relation to the undercarriage 110. The traverser 50 ensures the movement of the new sleepers from the first receiving zone Z1 up to the second conveying platform P2, as well as the movement of the worn sleepers from the second receiving zone Z2 up to the first conveying platform P1. By movement, it is meant here that a transporting takes place by the lifting and displacing of a load, consisting here of one or more sleepers, from one point to another, here from the receiving zone to the conveying platform. The first and second conveying platforms P1, P2 are each distant from the first and second receiving zones Z1, Z2 along a longitudinal direction X of the transfer car 100. The traverser 50 is situated, in relation to the longitudinal direction X of the transfer car 100, between the receiving zone Z1, Z2 and the conveying platform P1, P2. In this way, the implementing of the traverser 50 allows an assured continuity of the evacuation stream C1 of the worn sleepers 22 and the supply stream C2 of new sleepers 21.

The travel of the worn sleepers 22 is as follows: the equipment for removing 12 worn sleepers 22 extracts one by one and in a repetitive and successive manner the worn sleepers 22, then places them on a first evacuation conveying device A1; these worn sleepers 22 are then routed by the first evacuation conveying device A1 up to the second zone Z2 for receiving worn sleepers 22, where they are picked up by the traverser 50, which moves them up to the first platform P1 for conveying of the worn sleepers 22, from which said worn sleepers 22 are conveyed toward a storage zone of the railway vehicle 1 by a second evacuation conveying device A2. In other words, the first platform P1 for conveying of the worn sleepers 22 is configured to receive the worn sleepers 22 by the traverser 50 in order to be conveyed toward the storage zone of the railway vehicle 1.

The first and second evacuation conveying devices A1, A2 here are chain-type conveying devices 70, preferably using metal chains mounted on supporting and driving devices 71 containing intermediate gear wheels such as toothed wheels and idler wheels. These devices often include tensioning elements (not shown), the purpose of which is to properly tension the chain or chains 70. Preferably, each of the first and second evacuation conveying devices A1, A2 comprises at least two chain drive paths, mounted in parallel, the worn sleepers 22 being then conveyed while resting on the two parallel chains at the same time. One chain drive path may be formed by the same single chain, circulating continuously in a closed loop, or by a succession of continuous chains circulating in closed loops arranged successively along this sleeper drive path. When several chains or chain drive paths are mounted in parallel and convey the same sleepers, some or all of the supporting and driving devices such as the intermediate gear wheels and the idler wheels may possibly be shared. Of course, variants of conveying devices may be utilized.

The second zone Z2 for reception of the worn sleepers 22 receives the worn sleepers 22 from the equipment for removal 12 of the worn sleepers 22 as well as the first platform P1 for conveying of the worn sleepers 22, from which said worn sleepers 22 are conveyed toward a storage zone of the railway vehicle 1, each of them comprising or being formed by one of the ends of the first and second evacuation conveying devices A1, A2, respectively. As a variant, or supplementally, the second zone Z2 for reception of the worn sleepers 22 may comprise a buffer zone situated in the prolongation of the first evacuation conveying device A1 and allow a temporary storing of a plurality of worn sleepers 22 prior to being handled collectively, in a pack. Such a buffer zone comprises, for example, a zone lacking any driving means or a zone containing one or more free or disengaged chains, that is, without a driving means engaging with the chains and able to force the chains in rotation at this so-called buffer conveying portion. In such a configuration, each worn sleeper 22 then ends its travel on the chains of the evacuation conveying device and comes into contact with and bears against the worn sleeper 22 situated in front of it, pushing or driving it in its displacement.

In parallel with the evacuation stream C1 of the worn sleepers 22, the travel of the new sleepers 21 feeding the supply stream C2 of new sleepers is as follows: the new sleepers 21 are routed in stacks from a storage zone of the railway vehicle 1 up to the first zone Z1 for receiving and unstacking of the new sleepers 21 by a routing conveying device B1, where they are picked up by the traverser 50, which moves the new sleepers 21 up to the second platform P2 for conveying of the new sleepers 21, from which said new sleepers 21 are conveyed to the equipment for laying down 11 the new sleepers 21 by a second routing conveying device B2. In other words, the second platform P2 for conveying of the new sleepers 21 is configured to receive the new sleepers 21 by the traverser 50 in order to be conveyed to the equipment for laying them down 11. The traverser 50 which handles these operations is that same as the one performing the transfer operations of the evacuation stream C1 of the worn sleepers 22. Thus, one and the same traverser 50 implements the streams C1 and C2.

The second conveying platform P2 comprises, or is formed by, one of the ends of the second routing conveying device B2. This second routing conveying device B2 may be a chain-type conveyor 70 as described in reference to the evacuation conveying devices A1, A2.

The first routing conveying device B1 comprises, or is formed by, a displacement mechanism 130 for stacks 21' of new sleepers 21 in order to move said stacks 21' of sleepers in translation, step by step, toward and up to the first zone Z1 for receiving and unstacking of the new sleepers 21. The displacement mechanism 130 preferably comprises carts 131 configured to be placed on a guide track 132, each cart 131 being configured to support a stack 21' of new sleepers 21.

The displacement mechanism 130 is configured to move each cart 131 back and forth by one step p corresponding to a distance greater than the length 1 of a stack of new sleepers 21, taken in the longitudinal direction, preferably being slightly greater than this. Each cart 131 carries a stack 21' of new sleepers 21, having lifted it up, along a forward path, displacing it by one step p in the direction of the first zone Z1 for receiving and unstacking of the new sleepers 21, and then traveling a return path, opposite the forward path, being unloaded, thus, without moving the stack 21'. More generally, the back and forth movement of a given cart 131 is thus an alternating movement along the same path, in a forward direction, carrying a stack 21', 22' of sleepers 21, 22, and in a return direction, opposite the forward direction, and being unloaded, that is, not carrying a stack 21', 22' of sleepers 21, 22. Each cart 131 is thus moved in the manner of a shuttle between two positions. According to one advantageous characteristic, the carts 131 are joined in an articulated manner to form groups of several carts 131, for example, groups of three carts 131. In this way, one can easily manage the transfer of a stack 21' of new sleepers 21 between two cars.

More precisely, the new sleepers 21 are stored in stacks 21' on a carrying structure integrated with the undercarriage 110 by jacks, such as dual-acting hydraulic jacks, said carrying structure having two support beams located on either side of the carts 131. The carts 131 travel on the guide track 132 and are free to move in one longitudinal direction or the other, that is, forward or backward, without manipulating the new sleepers 21 when the carrying structure is in a vertically raised position at a level higher than that of the carts 131. The carts 131 travel on the guide track 132 and each of them transports a stack 21' of new sleepers 21 when the carrying structure is in a vertically lowered position and is situated beneath a support plane of the carts 131. A sequence of movement of the stacks of new sleepers 21 by the displacement mechanism 130 is for example the following: the carrying structure is lowered by the jacks, all the carts 131 being placed simultaneously each one beneath a stack 21' of new sleepers 21; they carry the stack 21' of new sleepers 21; they move the stack 21' of new sleepers 21 by a predetermined step p, and then the moved stack 21' of new sleepers 21 is lifted by the carrying support structure, actuated by the jacks, and the carts 131 then return empty or unloaded to their starting position in order to be positioned underneath another stack 21' of sleepers 21, which is also going to be moved during the sequence. The repetition of the sequence in a cycle enables a movement of the stacks 21' of new sleepers 21 step by step in the direction of the first zone Z1 for receiving and unstacking of new sleepers 21.

The transfer car 100 comprises an elevating mechanism 120 in the first zone Z1 for receiving and unstacking of the new sleepers 21, where the stacks of sleepers moved by the displacement mechanism 130 converge one by one. This elevating mechanism 120, as each stack 21' of the new sleepers 21 is unstacked, raises the stack 21' by a predetermined height, such that the new sleepers 21 located at an upper end layer of the stack are positioned at a predetermined height and can be easily picked up by the traverser 50, improving the speed of movement of said traverser 50.

In this embodiment, there is a single traverser 50. The armature 60 which supports it comprises a plurality of vertically upright stanchions 62 carrying at least two horizontal beams 63 on which are arranged rails 61 for guiding and supporting a shuttle 53 able to move in translation longitudinally with respect to the armature 60. The stanchions of the armature are fixed in relation to the undercarriage 110 of the transfer car 100. The movable shuttle 53 forms a horizontal structure moving on the two guide paths formed by the rails 61, said shuttle 53 comprising at least one transverse beam, that is, extending transversely between the two rails 61, and preferably two beams, forming a traveling bridge guided by the guiding and support rails 61.

The traverser 50 further comprises a system for gripping 51 of at least one sleeper 21, 22 suspended by a lifting system 52 from the shuttle 53. The lifting system 52 is a cable-type lifting system. The system for gripping 51 preferably comprises a spreader configured to transport a plurality of sleepers 21, 22 grouped to form a pack. Preferably, an operating mode will be chosen where the traverser 50 moves the sleepers 21, 22 in a pack of a single layer, that is, during their transfer the sleepers 21, 22 are not placed one on top of the other, but rather alongside each other.

The system for gripping 51 comprises a spreader formed by one or more beams joined together and having jaws at their transverse ends, facing each other, such as L-shaped jaws, each jaw being articulated at its end to the spreader, and being controlled to pivot by a jack (not shown).

The working of the traverser 50, in particular that of the shuttle 53, the lifting system 52, and the system for gripping 51, occurs overall inside a volume bounded by the armature 60 with the undercarriage 110 of the transfer car 100. Furthermore, whatever the working path of the traverser 50, this is contained for all positions of its trajectory in a volume bounded laterally by a gage of the transfer car 100 for sleepers, preferably by a gage of its undercarriage 110, further preferably by the volume bounded by the armature 60. In this way, while ensuring the safety of the people on board the transfer car 100, the car presents a footprint not going beyond that of a conventional railway car.

The first conveying platform P1 and the first receiving zone Z1 are closer to a first end 101 of the transfer car 100 than the second conveying platform P2 and the second receiving zone Z2. In particular, the first conveying platform P1 and the first receiving zone Z1 are close to the front end 101 of the transfer car 100, while the second conveying platform P2 and the second receiving zone Z2 are closer to a second end 102 of the transfer car 100, namely, the rear end.

Furthermore, while being situated at different heights, the first conveying platform P1 is closer to the first end 101 of the transfer car 100 than the first receiving zone Z1. In similar fashion, the second conveying platform P2 is closer to the second end 102 of the transfer car 100 than the second receiving zone Z2. In general, the longitudinal offsets of the first and second platforms P1, P2 and the first and second zones Z1, Z2 allow an accessibility by the traverser 50 along the same axis, corresponding to its axis of translation along the armature 60.

Figure 2:
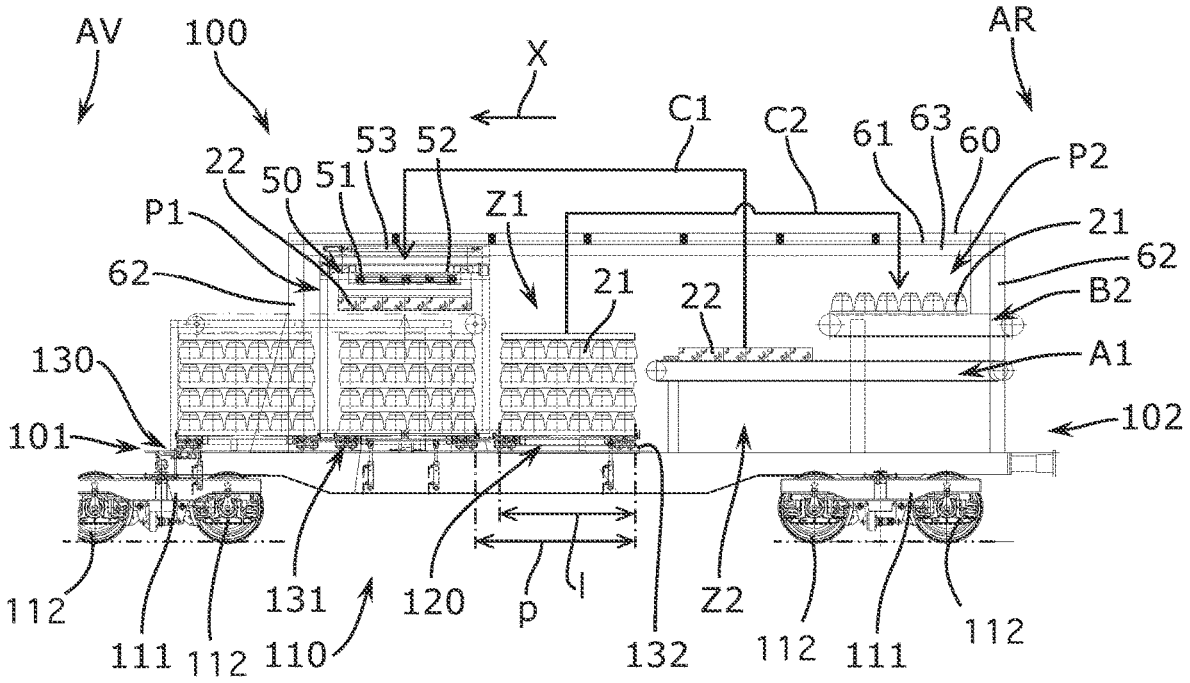
FIG. 2: a side view of a transfer car according to this first embodiment of the invention.

In the embodiment of FIGS. 1 and 2 in particular, the first conveying platform P1 is situated at a height greater than that of the first receiving zone Z1 and the second conveying platform P2 is situated at a height greater than that of the second receiving zone Z2. By positioning the first conveying platform P1 at a height greater than that of the first receiving zone Z1, and in relation to the storage cars 300, the second evacuation conveying device A2 is located above the first routing conveying device B1. The storage of the sleepers is in the form of stacks of sleepers and is located beneath the second evacuation conveying device A2, which in turn transports the sleepers in a pack of a single layer of sleepers, that is, without the sleepers being placed one on top of another. This allows the center of gravity to be as low as possible, thus assuring better stability for the different railway cars, such as the transfer car 100 and the storage cars 300.

Thanks to the arrangement of the first conveying platform P1 in relation to the first receiving zone Z1 and that of the second conveying platform P2 in relation to the second receiving zone Z2, these evacuation C1 and supply streams C2 are crossed here. Since the traverser 50 alone handles the two streams, namely, the evacuation stream C1 of the worn sleepers 22 and the supply stream C2 of new sleepers 21, the transfer steps are carried out in a sequenced manner.

Along a longitudinal axis X, the first and second platforms P1, P2 and the first and second zones Z1, Z2 are situated such that the traverser 50 is able to travel on the evacuation stream C1 and the supply stream C2 in longitudinal translation with respect to the armature 60, following a single back and forth path between two longitudinal end positions. In general, the vertical projections of the first and second platforms P1, P2 and the first and second zones Z1, Z2 are aligned along the same longitudinal axis, the first and second platforms P1, P2 and the first and second zones Z1, Z2 possibly being situated at different levels or heights. In this first embodiment, the transfer car 100 comprises, along a longitudinal direction X from the rear to the front: the first conveying platform P1, the first receiving zone Z1, the second receiving zone Z2 and then the second conveying platform P2.

Figure 3:
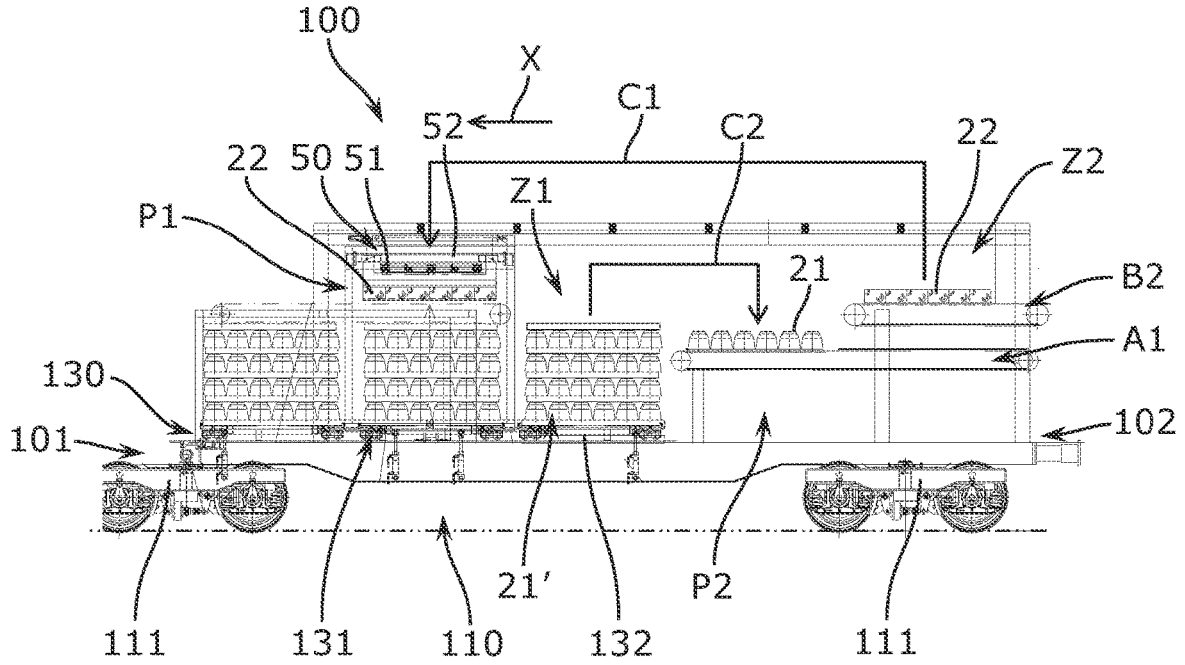
FIG. 3: a side view of a transfer car according to a second embodiment of the invention.
Figure 4:
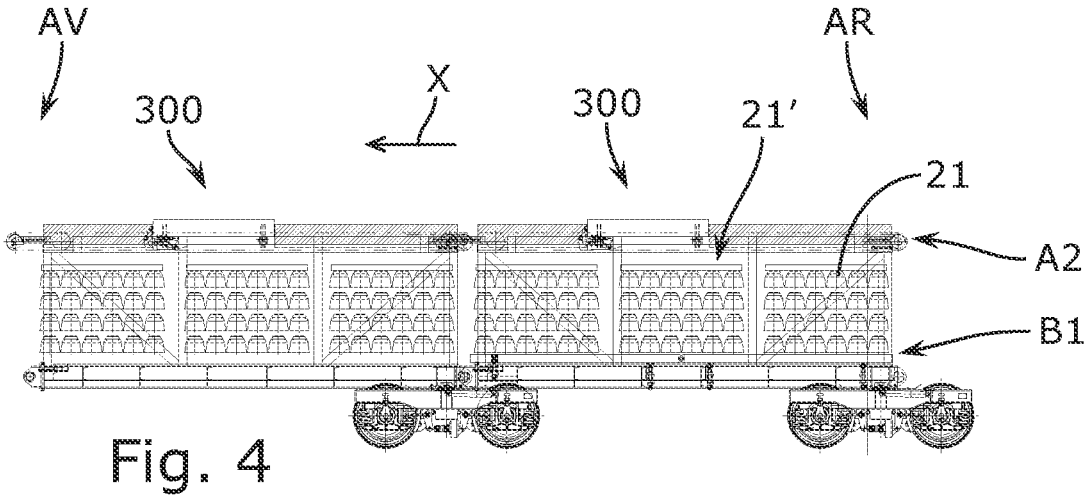
FIG. 4: a side view of a storage car according to one embodiment of the invention.

Referring to FIG. 3, this second embodiment of the invention differs from the first in that the second receiving zone Z2 is situated at a greater height than that of the second conveying platform P2. Moreover, in this second embodiment, the second receiving zone Z2 is closer to a second end 102 of the transfer car 100 than the second conveying platform P2 so that the transfer car 100 comprises, along a longitudinal direction from the rear to the front: the first conveying platform P1, the first receiving zone Z1, the second conveying platform P2 and then the second receiving zone Z2.

Figure 5:
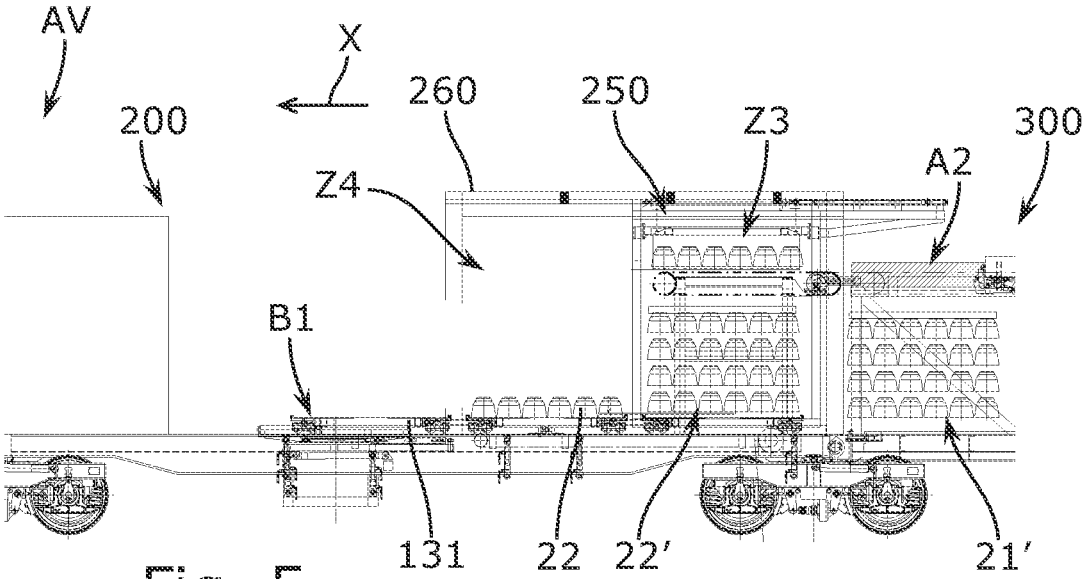
FIG. 5: a side view of a car for stacking of worn sleepers according to one embodiment of the invention.

The railway vehicle 1 likewise comprises a car 200 for stacking of worn sleepers 22, illustrated in FIG. 5. This stacking car 200 is located directly after the storage cars 300, which are themselves located directly after the transfer car 100 in the direction from the rear AR to the front AV of the railway vehicle 1. The stacking car 200 comprises a stacking traverser 250 which transfers the worn sleepers 22 from a third zone Z3 for reception of the worn sleepers 22 coming from the transfer car 100 after having been conveyed by the second evacuation conveying device A2, to be placed on a stack 22' of worn sleepers 22 for stacking them up. This stacking zone Z4 is situated on the carrying structure above the guide track 132 of the carts 131. In this way, once the stack 22' of worn sleepers 22 has been completed by the armature 260, it can be moved forward by the displacement mechanism 130 with a certain predetermined step p, corresponding to the step p of the movement of the stack of new sleepers 21' toward the first receiving zone Z1. These operations are concomitant, since the railway vehicle 1 lays down as many new sleepers 21 as it removes worn sleepers 22. In this way, when a stack of new sleepers 21 becomes empty at the front of the storage zone, in the first receiving zone Z1, a stack 22' of worn sleepers 22 is completed at the rear of the storage zone, in the stacking zone Z4. The stacking zone Z4 and the first receiving zone Z1 form the two longitudinal ends of the first routing conveying device B1.

The third receiving zone Z3 comprises, or is formed by one of the ends of the second evacuation conveying device A2, opposite the end comprising the first conveying platform P1. A buffer zone (not illustrated) may likewise be provided to receive the sleepers.

The single stacking traverser 250 is supported by an associated armature 260, this armature 260 being supported by the undercarriage and fixed in relation to that undercarriage. This stacking traverser 250 may have a design similar to that of the transfer traverser 50, but it may have a more reduced dimension, since the path to be traveled is shorter.

The stacking car 200 furthermore comprises a turntable system (not illustrated), making it possible to pivot at least one stack of sleepers, for example by 90°, in order to facilitate their handling by a manipulating means outside of the machine.

Figure 6:
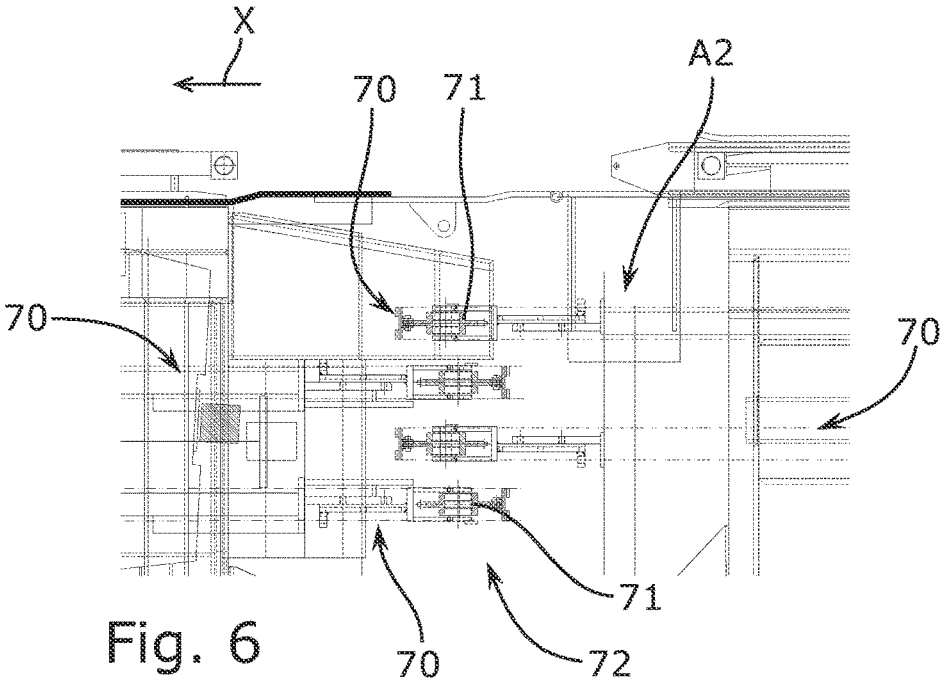
FIG. 6: a top view of a junction between two conveyors.

FIG. 6 illustrates a crossover 72 or overlapping in the same horizontal plane of two pairs of chains 70 of a chain-type conveying device 70. Such a nesting of two pairs of chains, each of them continuous and traveling in a closed loop, arranged in succession along the driving path, ensures a continuity of displacement in the conveying of the sleepers 21, 22. Furthermore, this crossover of end portions of the two pairs of chains 70 is realized in such a way as to provide a predetermined spacing sufficient to allow a minimal articulation between the two conveying portions, each one formed by a pair of chains. Such a configuration is particularly advantageous at the intersection between two railway cars and it assures a perfect conveying of the sleepers 21, 22, without being affected by the curves in the railroad track on which the train 1 is traveling.

Figure 7:
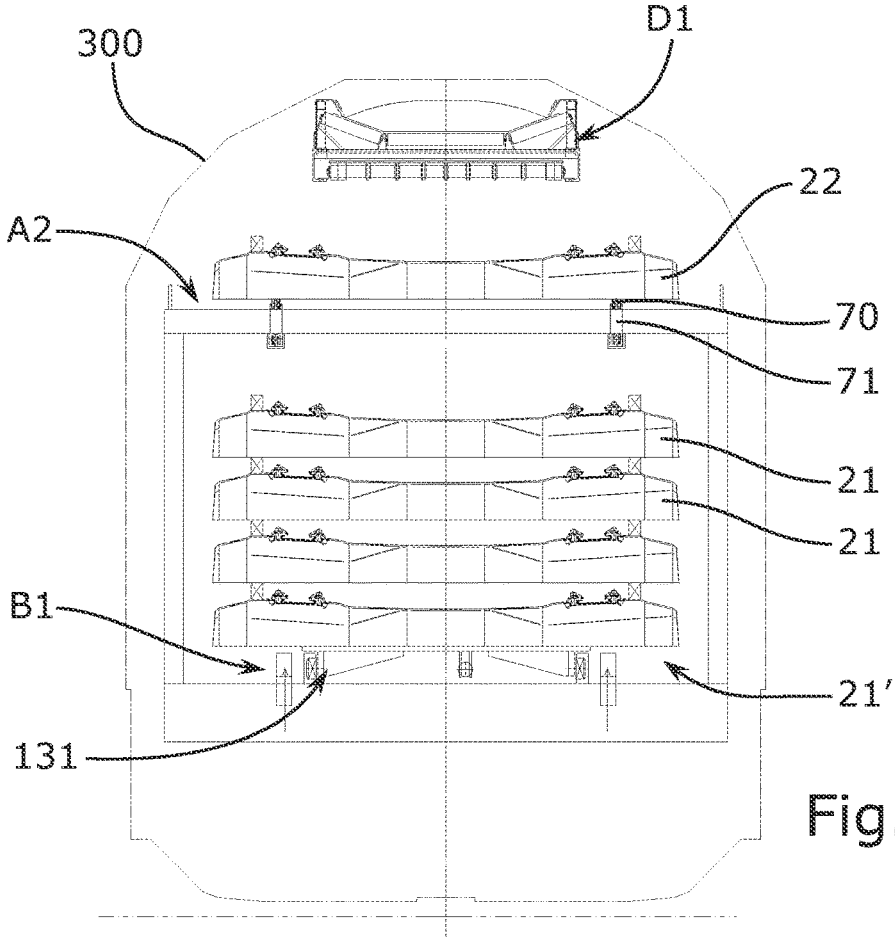
FIG. 7: a simplified cross-sectional view of a storage car of a railway vehicle, according to one embodiment of the invention.

FIG. 7 illustrates a cross-sectional view of a storage car 300 in one embodiment. In particular, there can be seen in this figure a third conveying device D1 configured to transport material such as ballast. This cross-sectional view illustrates in particular a positioning of the third conveying device D1 which is situated vertically above the first evacuation conveying device B1 and the second evacuation conveying device A2. The railway car illustrated here is located upstream from the transfer car 100 in relation to the forward direction of the train. On a portion situated downstream from the transfer car 100 in relation to the forward direction of the train, one will choose in this case a positioning of the third conveying device D1 which is located vertically above the second routing conveying device B2 and the first evacuation conveying device A1. In this case, in order to assure a continuity of the conveying at the third conveying device D1, one will place said third conveying device D1 vertically above the conveyor 50 at the level of the transfer car 100. Of course, the invention is described in the preceding as an example. It is understood that the person skilled in the art may realize different variant embodiments of the invention without thereby leaving the scope of the invention.

The first evacuation conveying device B1 may optionally be composed of a belt-type conveyor. Alternatively, one may also contemplate a cart-type conveyor 131, where the carts 131 are moved step by step with the stacks 21' of new sleepers 21 from the storage cars 300 up to the first zone Z1 for receiving and unstacking of the new sleepers 21, then being evacuated by the traverser 50 to the first platform P1 for conveying of the worn sleepers 22, from which the carts 131 can be conveyed along with the worn sleepers 22 to the storage zone of the railway vehicle 1, where they are further used for the storing of the worn sleepers 22.

It is emphasized that all the characteristics which become evident to a person skilled in the art from the present specification, the drawings, and the attached claims, even if only described specifically in connection with other particular characteristics, either individually or in any given combination, may be combined with other characteristics or groups of characteristics which are disclosed here, unless that is expressly excluded or unless technical circumstances render such combinations impossible or meaningless.

The invention claimed is:

1. A transfer car for sleepers designed to outfit a railway vehicle, the railway vehicle comprising equipment for laying down new sleepers and/or equipment for removing worn sleepers and a storage zone for sleepers, the transfer car comprising only a single undercarriage supported by at least one running gear, wherein the transfer car comprises an armature supported by the single undercarriage and fixed in relation to the single undercarriage, and a single traverser supported by the armature, the transfer car comprising, on the single undercarriage:

a first zone for reception and unstacking of new sleepers configured to receive the new sleepers coming from the storage zone of the railway vehicle;

a first platform for conveying worn sleepers from which the worn sleepers can be conveyed to the storage zone of the railway vehicle;

a second zone for reception of the worn sleepers configured to receive the worn sleepers from the equipment for removal of the worn sleepers, the second zone for reception of worn sleepers being distant from the first platform for conveying of the worn sleepers along the longitudinal direction of the transfer car;

a second platform for conveying new sleepers from which the new sleepers can be conveyed to the equipment for laying down the new sleepers, the second platform for conveying the new sleepers being distant from the first zone of reception and unstacking of the new sleepers along a longitudinal direction of the transfer car;

the traverser being located, in relation to the longitudinal direction of the transfer car, between the first receiving zone and the second platform, and between the first platform and the second receiving zone, the traverser being configured to move the new sleepers from the first receiving zone to the second conveying platform and to move the worn sleepers from the second receiving zone to the first conveying platform.

2. The transfer car for sleepers according to claim 1, wherein the conveying platform and the receiving zone are situated at different heights.

3. The transfer car for sleepers according to claim 1, wherein the armature supporting the traverser is contained in a volume bounded laterally by a gage of the sleeper transfer car.

4. The transfer car for sleepers according to claim 1, wherein the traverser comprises a system for gripping at least one sleeper suspended from a lifting system which is movable relative to the armature, the system for gripping comprising a spreader configured to transport a plurality of sleepers grouped in a pack.

5. The transfer car for sleepers according to claim 4, wherein the lifting system is carried by a shuttle which is movable in translation relative to the armature.

6. The transfer car for sleepers according to claim 5, wherein the armature has rails for guiding and supporting the movable shuttle, situated above the at least one receiving zone and the at least one conveying platform above the first receiving zone and the second conveying platform, and above the second receiving zone and the first conveying platform.

7. The transfer car for sleepers according to claim 1, wherein the first conveying platform is situated at a height greater than that of the first receiving zone and/or in that the second conveying platform is situated at a height greater than that of the second receiving zone.

8. The transfer car for sleepers according to claim 1, wherein the first conveying platform and the first receiving zone are closer to a first end of the transfer car than the second conveying platform and the second receiving zone.

9. The transfer car for sleepers according to claim 1, wherein it comprises an elevating mechanism in at least one of the receiving zones in the first zone for reception and unstacking of the new sleepers, being configured to position at least one sleeper, and a pack of sleepers, at a predetermined height.

10. The transfer car for sleepers according to claim 1, wherein it comprises at least one portion of a displacement mechanism for stacks of sleepers to move said stacks of sleepers in translation toward at least one of the receiving zones towards the first zone for reception and unstacking of the new sleepers, the displacement mechanism comprising carts configured to be placed on a guide track located beneath the stacks of sleepers.

11. The transfer car for sleepers according to claim 10, wherein the displacement mechanism is configured to move each cart back and forth by one step corresponding to a distance greater than the length of a stack of sleepers, the displacement mechanism being configured such that each cart carries a stack of sleepers along a forward path, and configured to travel a return path, opposite the forward path, after being unloaded, and without moving the sleepers.

12. The transfer car for sleepers according to claim 1, wherein it comprises a third conveying device for the conveying of material situated vertically beneath the traverser.

13. A vehicle for railway work of the type comprising equipment for laying down new sleepers and/or for removing worn sleepers, the railway vehicle comprising at least one sleeper storage car comprising a storage zone for sleepers, one or more cars containing equipment for laying down new sleepers and/or for removing worn sleepers from a railroad track, wherein it furthermore contains a transfer car according to claim 1.

14. A method for transfer of sleepers implemented on a transfer car for sleepers designed to outfit a railway vehicle of the type comprising equipment for laying down new sleepers, equipment for removing worn sleepers, and a storage zone for sleepers, the transfer car comprising only a single undercarriage supported by at least one running gear, the transfer car comprising an armature supported by the single undercarriage and fixed in relation to the single undercarriage, the transfer car further comprising, on the signle undercarriage:

a first zone for reception and unstacking of new sleepers configured to receive the new sleepers coming from the storage zone of the railway vehicle;

a first platform for conveying worn sleepers from which the worn sleepers can be conveyed to the storage zone of the railway vehicle;

a second zone for reception of the worn sleepers configured to receive the worn sleepers from the equipment for removal of the worn sleepers, the second zone for reception of worn sleepers being distant from the first platform for conveying of the worn sleepers along the longitudinal direction of the transfer car;

a second platform for conveying new sleepers from which the new sleepers can be conveyed to the equipment for laying down the new sleepers, the second platform for conveying the new sleepers being distant from the first zone of reception and unstacking of the new sleepers along a longitudinal direction of the transfer car;

wherein the transfer method involves at least one step of transfer of at least one new sleeper from the first receiving zone to the second conveying platform, and a step of transfer of at least one worn sleeper from the second receiving zone to the first conveying platform, by a single traverser supported by the armature, the traverser being situated, in relation to the longitudinal direction of the transfer car, between the first receiving zone and the second platform, and between the first platform and the second receiving zone.

* * * * *